US007119695B2

(12) United States Patent
Defant et al.

(10) Patent No.: US 7,119,695 B2
(45) **Date of Patent: *Oct. 10, 2006**

(54) ADVANCED HOUSE ARREST TRACKER SYSTEM

(75) Inventors: John C. Defant, Palm Harbor, FL (US); Robert P. Posavec, Palm Harbor, FL (US); David S. Segal, Palm Harbor, FL (US)

(73) Assignee: Pro Tech Monitoring, Inc., Odessa, FL (US)

( * ) Notice: Subject to any disclaimer, the term of this patent is extended or adjusted under 35 U.S.C. 154(b) by 110 days.

This patent is subject to a terminal disclaimer.

(21) Appl. No.: 10/989,028

(22) Filed: Nov. 15, 2004

(65) Prior Publication Data

US 2006/0103537 A1 May 18, 2006

(51) Int. Cl.
*G08B 23/00* (2006.01)

(52) U.S. Cl. ..... 340/573.4; 340/573.1; 340/573.3; 340/825.49; 340/539.13; 340/539.31; 379/37; 379/38; 379/39

(58) Field of Classification Search ..... 340/573.4, 340/573.1, 573.3, 825.49, 539.13, 539.31, 340/539; 379/37, 38, 39
See application file for complete search history.

(56) References Cited

U.S. PATENT DOCUMENTS

| | | | | |
|---|---|---|---|---|
| 6,100,806 | A * | 8/2000 | Gaukel | 340/573.4 |
| 6,405,213 | B1 * | 6/2002 | Layson et al. | 707/104.1 |
| 6,774,799 | B1 * | 8/2004 | Defant et al. | 340/573.4 |
| 2005/0040944 | A1 | 2/2005 | Contestabile | |

* cited by examiner

*Primary Examiner*—Tai Nguyen
(74) *Attorney, Agent, or Firm*—Larson & Larson, PA.; Frank Liebenow; Herbert Larson

(57) ABSTRACT

A docking station is located in an offender's home. It is connected to a transformer, and a wireless modem. The docking station includes a processor board containing a microprocessor which receives the offender's home schedule from a central monitoring station via a cellular network and communicates with a miniature tracking device positioned in the docking station when the offender is at home and on the belt of an offender when he is away from home. The miniature tracking device receiving GPS signals. A tamper resistant bracelet transmitter permanently positioned on the offender's ankle communicates by wireless transmission to the tracking device.

15 Claims, 7 Drawing Sheets

ADVANCED HOUSE ARREST TRACKER SYSTEM

TECHNICAL FIELD

This invention relates to electronic monitoring and tracking of persons. More particularly, it refers to a miniature tracking device attached to an offender's belt communicating with a body-worn transmitter, the miniature tracking device alerting the offender of violations and displaying messages from a probation officer when connected to a docking station.

BACKGROUND OF THE INVENTION

The capacity of probation officers to keep close track of offenders under house arrest was enhanced by the invention set forth in U.S. Pat. No. 5,731,757. The system described in this patent provided for the use of a global positioning system (GPS) to determine the position of a portable tracking apparatus adapted to communicate with an offender's body-worn device. The portable tracking apparatus communicates with a central data base or monitoring station and sends and receives wireless signals from the offender's body-worn device. The portable tracking device warns the offenders if he deviates from a programmed circle of travel, the central data base being able to provide warnings to a potential victim if the subject offender violates a zone of protection. While this system works well, a need has arisen for a simple house arrest system that in addition to tracking, can be provided to law enforcement agencies at a reduced cost.

SUMMARY OF THE INVENTION

The present invention is a system solving this need by providing a miniature tracking device that can be removably clipped to an offender's belt when outside the home and communicates directly with an offender's permanent ankle bracelet. The invention is a complete house arrest system which ensures that offenders are within the confines of their home for a pre-defined scheduled period, but provides simplified GPS tracking while outside the home. A docking station receives the miniature tracking device and is located in the offender's home. The docking station is used to recharge the miniature tracking device and communicate via a wireless system to a central data or monitoring station all location history information, violation information and house arrest status.

BRIEF DESCRIPTION OF THE DRAWINGS

The invention can be best understood by those having ordinary skill in the art by reference to the following detailed description when considered in conjunction with the accompanying drawings in which.

DETAILED BEST MODE DESCRIPTION

Figure 1:
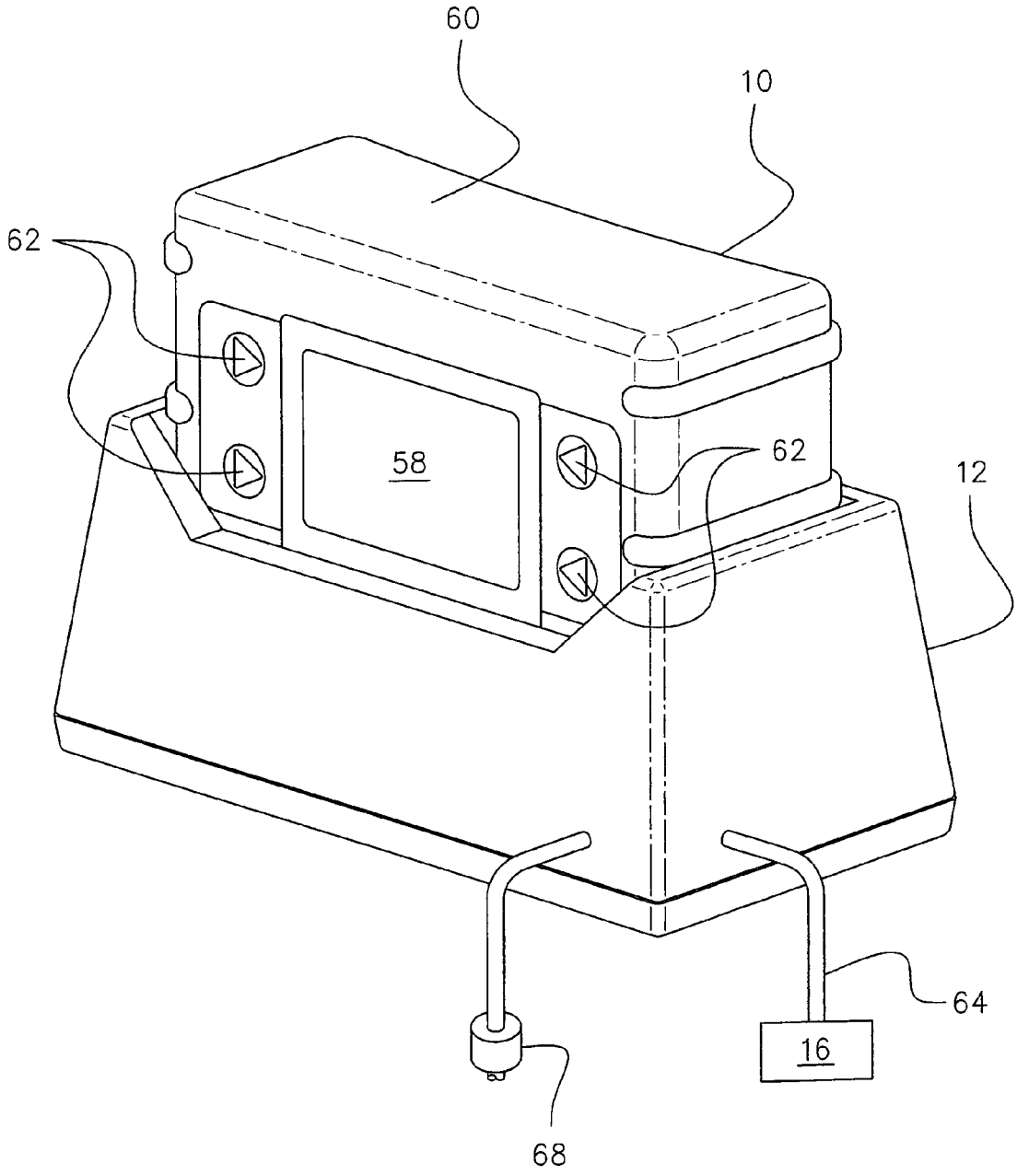
FIG. 1 is a perspective view of the miniature tracking device resting in its docking station.

Throughout the following detailed description, the same reference numerals refer to the same elements in all figures.

Figure 2:
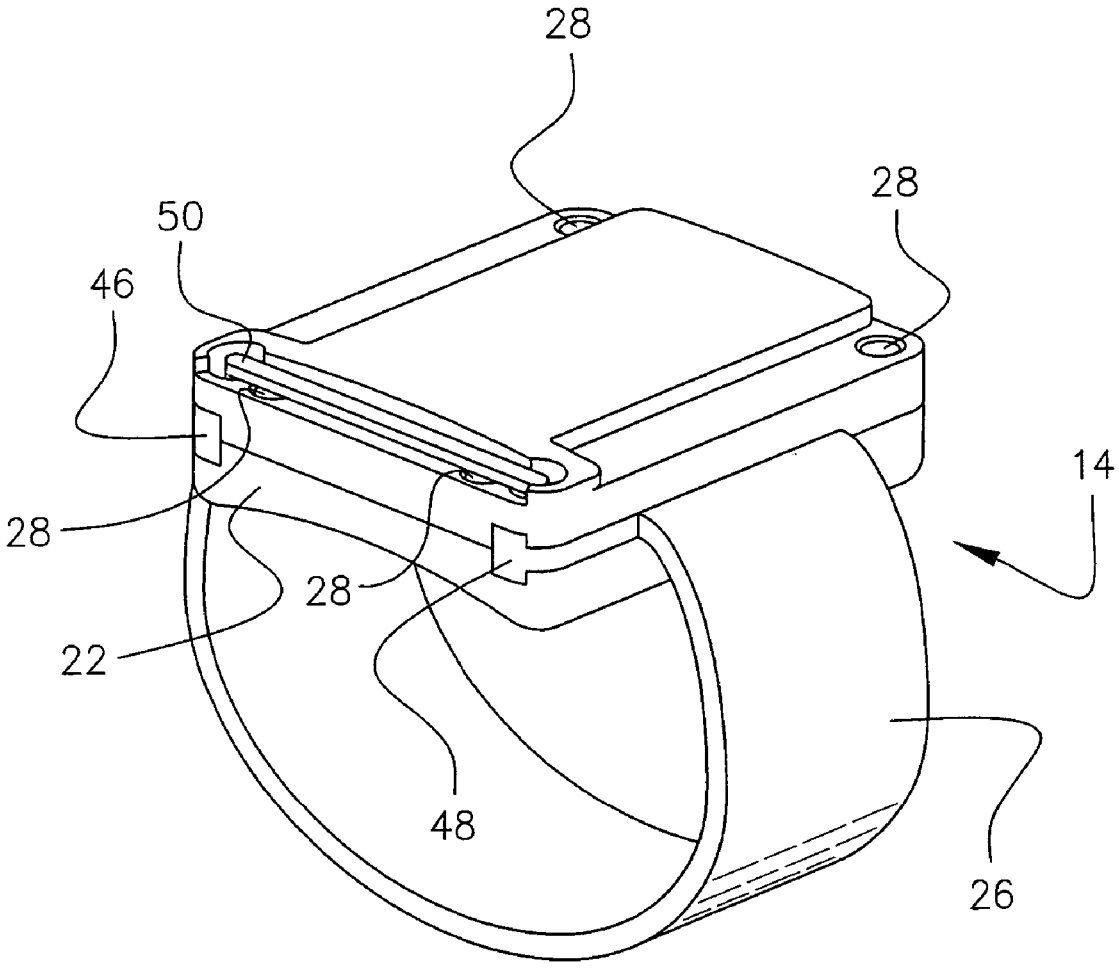
FIG. 2 is a perspective view of an ankle bracelet.
Figure 3:
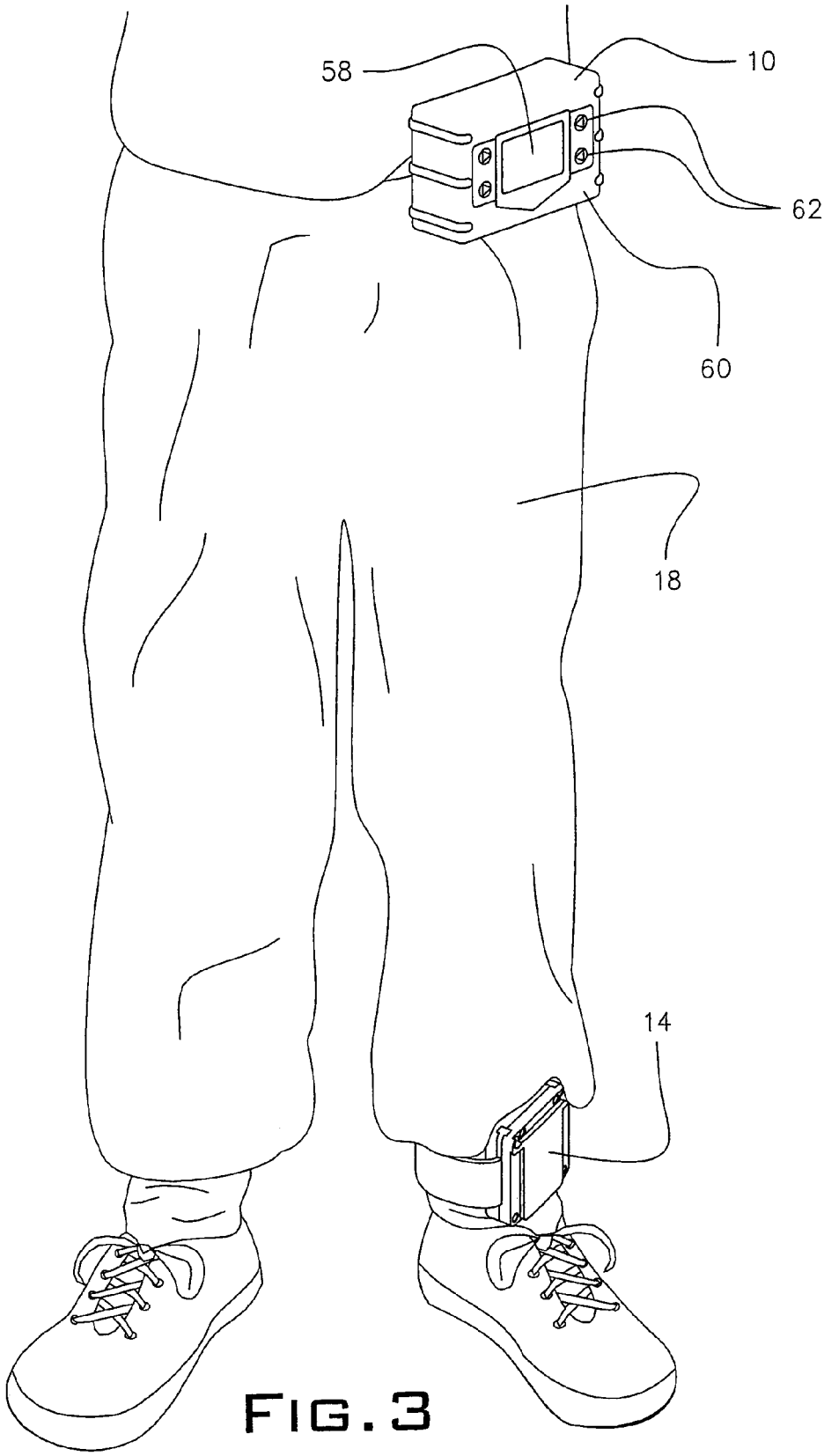
FIG. 3 is a view of an offender wearing the miniature tracking device and an ankle bracelet.
Figure 4:
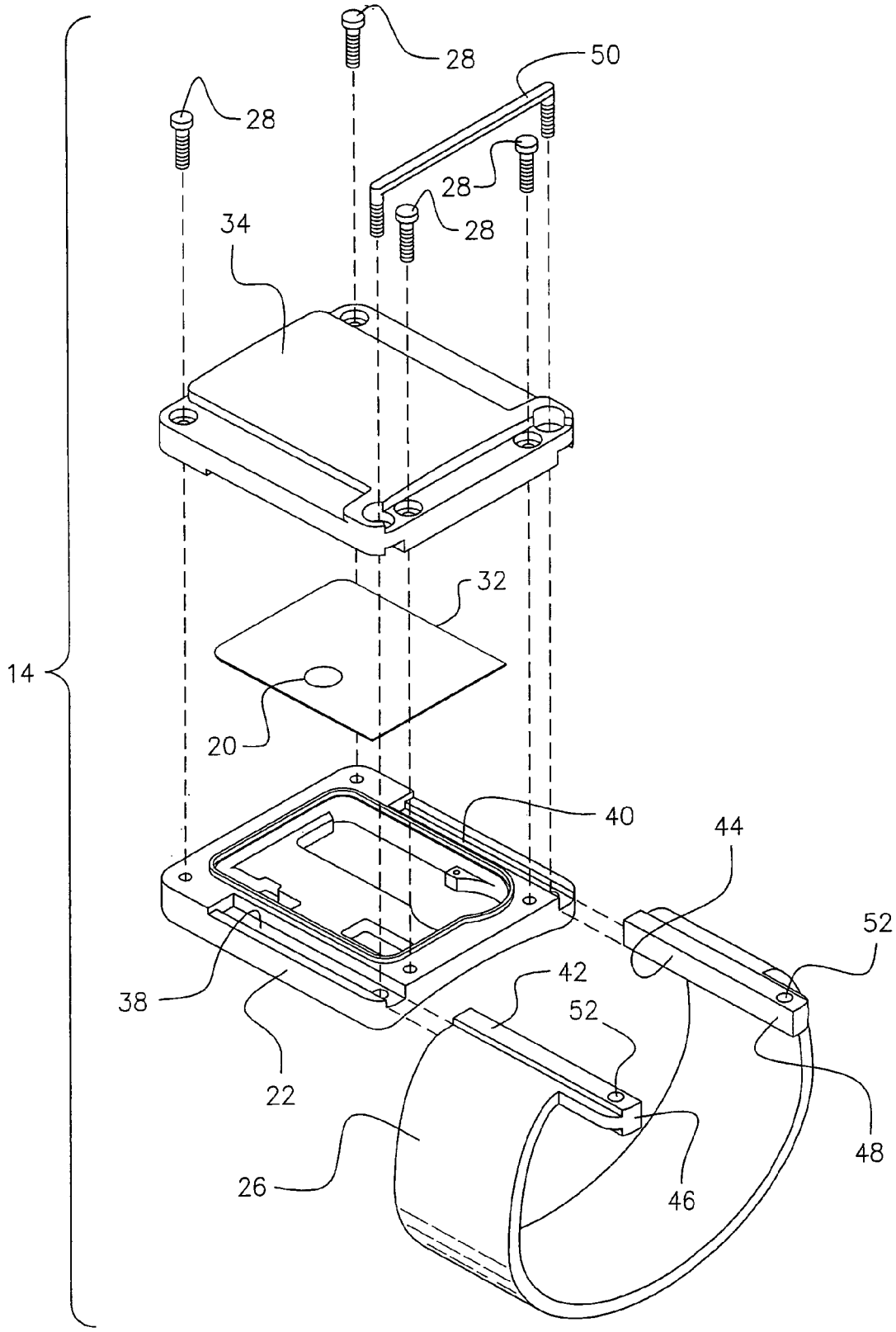
FIG. 4 is an exploded view of the ankle bracelet shown in FIG. 2.

Referring to FIG. 1, the house arrest tracker system includes a miniature tracking device (MTD) 10 shown mounted in a docking station 12 where the MTD 10 through the docking station 12 is recharged and communicates to a central monitoring center. An offender 18, at all times wears an ankle transmitter 14 and when away from home wears the MTD 10 strapped to his belt or carried with him as shown in FIG. 3. The ankle transmitter 14 shown in FIGS. 2 and 4 has a maximum operating distance with respect to the MTD of 125 to 150 feet. Further, the ankle transmitter 14 has an internal two-year battery 20 mounted directly to the circuit board 32 located in base housing 22. If strap 26 is removed, severed or otherwise subject to tampering, an internal electronic circuit sends a signal to the MTD 10. The ankle transmitter 14 is required to be worn at all times by the offender 18 whether in his or her home or outside the home with the MTD 10. Grooves 38 and 40 receive ends 42 and 44, respectively of the strap 26. The strap 26 is held in place by U-shaped insert 50. The housing 22 is a sealed unit permanently joining cover 34 to base 22. Push pins 28 connect the housing halves 34 and 22.

If the offender tampers with ankle transmitter 14 or strap 26, an alarm will be displayed on the MTD 10 liquid crystal display 58, provided the "notify offender" option has been selected.

The MTD 10 contains three circuit boards; namely, 1) a processor/GPS board 54 containing GPS receiver and processor 78, vibrator driver 118, analog to digital converter 84, tamper detection circuits 86, push buttons 62, power interface 90, memory board 56, liquid crystal display 58 and motion sensor 82; 2) Bracelet receiver board 32; and 3) Docking board 30 to interconnect the processor/GPS and bracelet receiver boards. The MTD 10 weighs less than one pound and is water resistant. The interior components of the MTD 10 are permanently sealed within housing 60 by ultrasonic welding so the MTD 10 cannot be disassembled. The liquid crystal display 58, shows the offender's name, date, time and battery status. The display 58 will alert the offender 18 of any violations when the MTD 10 is in the docking station 12. The four push buttons 62 are used to confirm messages received, clear notifications and assist with MTD 10 programming. Contacts (not shown) on the bottom of the MTD housing 60 engage contacts on a top surface of the docking station 12 to charge the MTD 10 battery 92. The battery charging is done through the transformer 68 which converts 110 volt electricity to 5 volts.

The docking station 12 has a wireless modem 98 to communicate via a cellular network system 64 with the central station 16.

Figure 5:
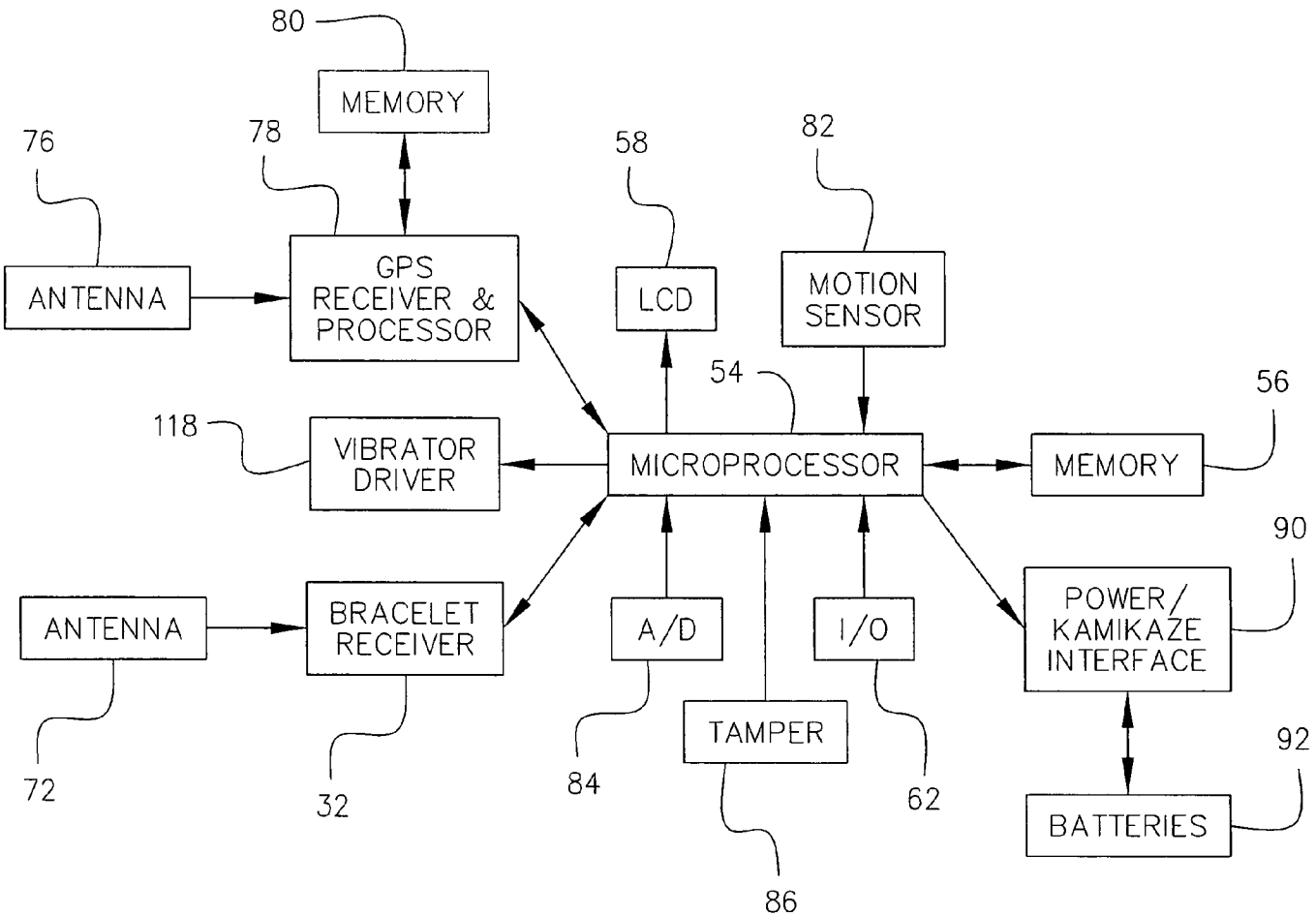
FIG. 5 is a block diagram of the miniature tracking device and bracelet components connected to the docking station.

Referring to FIG. 5, the bracelet receiver 32 has an antenna 72 which receives signals from the bracelet transmitter so that the ankle transmitter 14 is in direct communication with the miniature tracking device microprocessor 54. In turn, the miniature tracking device 10 has an antenna 76 receiving signals from GPS satellites. A position is calculated by the GPS receiver and processor 78. A memory chip 80 communicates with the GPS receiver and processor 78. The microprocessor 54 also receives input from a motion sensor 82, an analog to digital signal converter 84, a tamper detection circuit 86 and input/output buttons 62. The microprocessor can shut off all circuits through switch 90. Batteries 92 power the MTD. The microprocessor 54 activates a vibrator driver 118.

Figure 6:
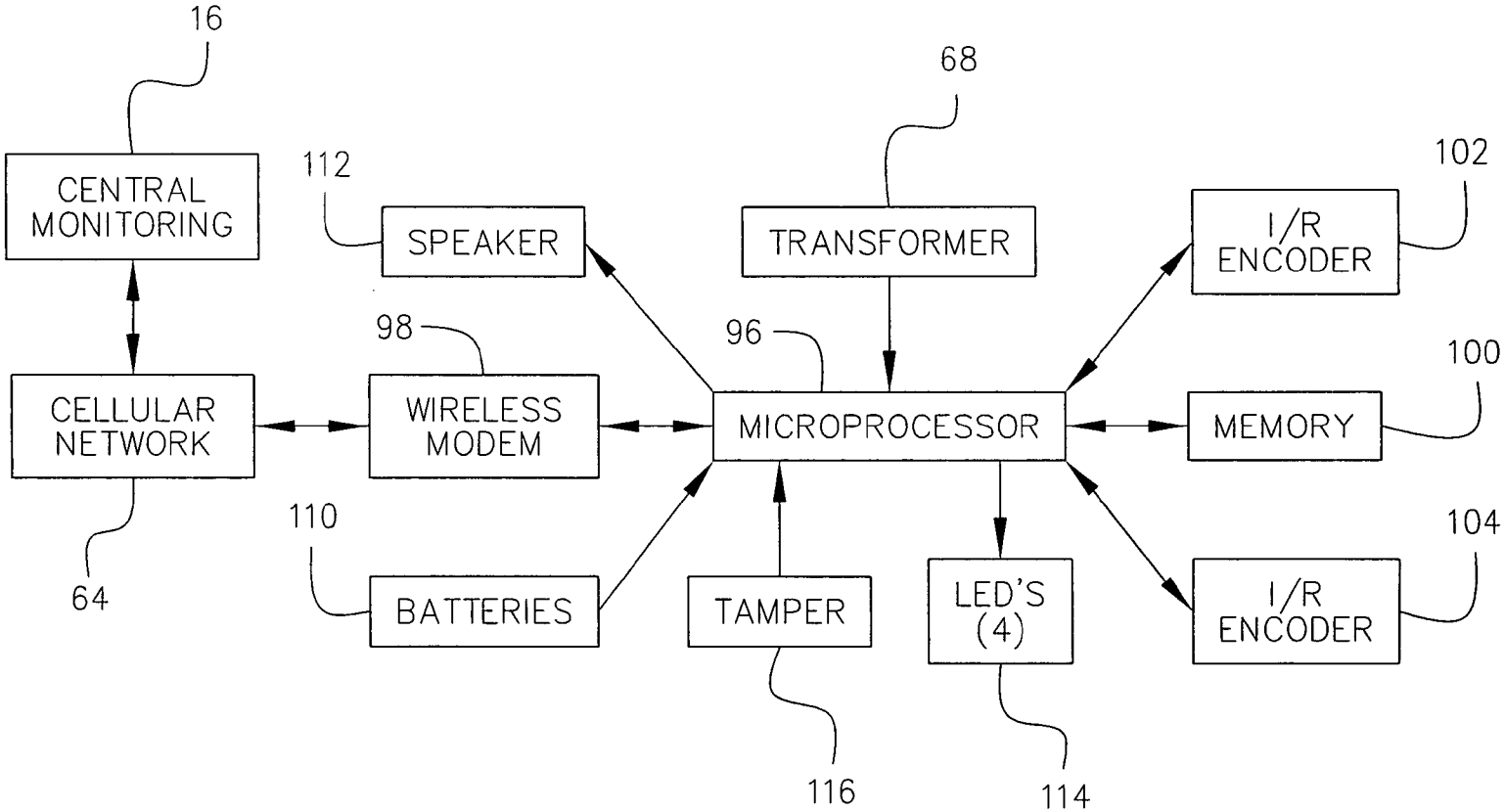
FIG. 6 is a block diagram of the docking station components connected to the central monitoring center.

Referring to FIG. 6, the docking station 12 has a microprocessor 96 which sends and receives signals from a wireless modem 98, a memory chip 100, and infrared encoders 102 and 104. A back up battery 110 provides alternate power to the microprocessor if transformer 68 is not operational. A speaker 112 and four light emitting diodes 114 receive signals from microprocessor 96. Tamper detection device 116 sends a signal to the microprocessor to alert the central processing station to tampering.

The four LED lights 114 on the docking station 12 indicate "power on", "curfew violation", "loss of phone" and "phone in use". The wireless modem 98 operates at speeds up to 38,400 BAUD. The back up battery 110 will operate for up to twenty-four hours without external power. The docking station speaker 112 will notify the offender with a series of beeps if the cellular network 64 is in-use when the docking station 12 needs to call the Surveillance Data Center 16. The tamper detection circuit 116 feeds directly to the microprocessor 96.

Figure 7:
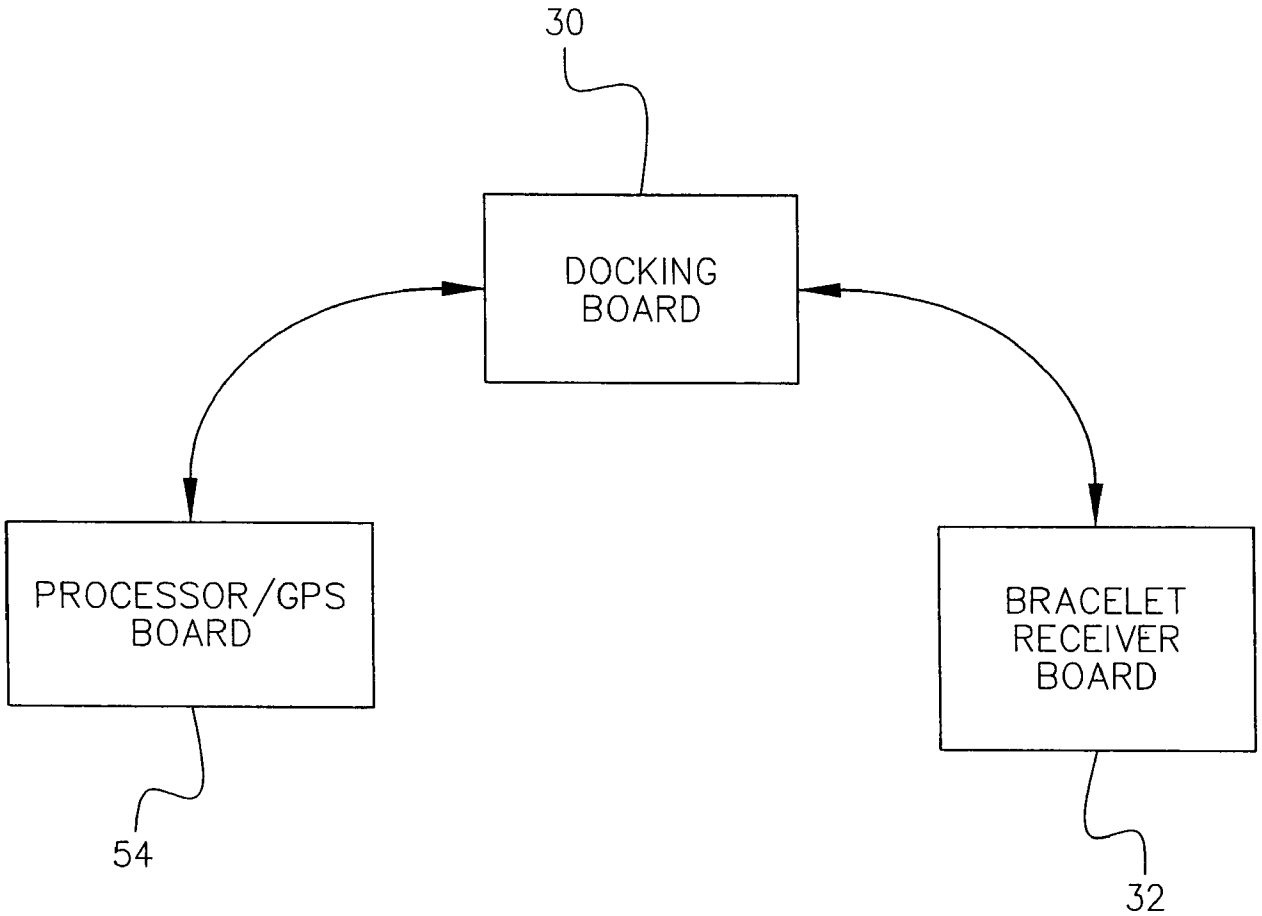
FIG. 7 is a diagrammatic description of the miniature tracking device circuit board interaction.

As seen in FIG. 7, in the MTD 10, the boards 32 and 54 transmit and receive signals from the docking board 30.

The housing for the MTD and the docking station can be made of a high strength polymer with internal components sealed in place to prevent tampering.

Other equivalent equipment can be substituted for the devices described herein to produce an offender tracking system. The description herein is limited only by the claims which follow.

Having thus described the invention what is claimed and desired to be secured by Letters Patent is:

1. A house arrest tracking system comprising:

a docking station located in an offender's home, the docking station connected to a wireless modem connected via a cellular network to a central monitoring station, the docking station containing a processor board and the wireless modem, the processor board containing a microprocessor with flash and random access memory and a contact for direct connection with a miniature tracking device;

an offender's home schedule loaded into the docking station microprocessor from the central monitoring station via the wireless modem;

the miniature tracking device positioned within the docking station when the offender is at home and positioned with the offender when the offender is out of his home;

a tamper resistant bracelet transmitter permanently positioned on the offender and communicating directly to the miniature tracking device; and the miniature tracking device receiving GPS signals.

2. The system according to claim 1 wherein the miniature tracking device is positioned on the belt of the offender when outside his home.

3. The system according to claim 1 wherein the tamper resistant bracelet is positioned on the ankle of the offender.

4. The system according to claim 1 wherein the miniature tracking device contains a battery providing power when the miniature tracking device is not connected to the docking station.

5. The system according to claim 4 wherein the miniature tracking device battery is recharged when connected to the docking station.

6. The system according to claim 1 wherein the miniature tracking device contains three circuit boards.

7. The system according to claim 6 wherein the circuit boards are a processor/GPS board, a bracelet receiver board and a docking board.

8. The system according to claim 1 wherein the miniature tracking device is enclosed within a sealed housing.

9. The system according to claim 1 wherein the docking station contains a backup battery that activates when electric power to the docking station is interrupted.

10. An apparatus for determining if an offender is violating a house arrest curfew comprising:

a docking station located in an offender's home containing a processor board including a microprocessor with flash and random access memory and means for communication with a miniature tracking device, the docking station further containing a wireless modem for contacting a central monitoring station via a cellular network, the docking station microprocessor loaded with a home schedule of the offender received from the central monitoring station via the cellular network;

a tamper resistant bracelet transmitter permanently positioned on the offender and in communication by wireless transmission to the miniature tracking device;

the miniature tracking device located in the docking station when the offender is at home and located with the offender when the offender is out of the home; and the miniature tracking device containing means for receiving a GPS signal to determine the position of the offender when the offender is out of the home.

11. The apparatus according to claim 10 wherein the docking station contains a back up battery which activates upon interruption of the standard home electric circuit.

12. The apparatus according to claim 10 wherein the miniature tracking device contains a battery providing power when the miniature tracking device is not connected to the docking station.

13. The apparatus according to claim 10 wherein the miniature tracking device contains multiple circuit boards.

14. The apparatus according to claim 13 wherein the multiple circuit boards comprise a processor/GPS board, a bracelet receiver board and a docking board.

15. The apparatus according to claim 10 wherein the docking station is connected to a transformer for connecting a 120 volt circuit to a 5 volt circuit.

* * * * *